US008584689B2

(12) United States Patent
Catton

(10) Patent No.: US 8,584,689 B2
(45) Date of Patent: Nov. 19, 2013

(54) PHYSICAL ASSISTANCE DEVICE CONFIGURABLE INTO A WALKER/ROLLATOR, SEAT OR TRANSPORT CHAIR

(76) Inventor: Douglas Catton, Hurricane, UT (US)

( * ) Notice: Subject to any disclaimer, the term of this patent is extended or adjusted under 35 U.S.C. 154(b) by 68 days.

(21) Appl. No.: 12/823,911

(22) Filed: Jun. 25, 2010

(65) Prior Publication Data

US 2010/0263697 A1 Oct. 21, 2010

Related U.S. Application Data

(63) Continuation-in-part of application No. 12/655,060, filed on Dec. 21, 2009.

(60) Provisional application No. 61/203,872, filed on Dec. 29, 2008.

(51) Int. Cl.
*A61H 3/04* (2006.01)

(52) U.S. Cl.
USPC ..... 135/67

(58) Field of Classification Search
USPC ..... 135/66, 67, 74; 297/5, 6
See application file for complete search history.

(56) References Cited

U.S. PATENT DOCUMENTS

| | | | | | |
|---|---|---|---|---|---|
| 2,374,182 | A * | 4/1945 | Duke | 297/6 |
| 2,556,121 | A | 6/1951 | Thomas | |
| 2,776,701 | A * | 1/1957 | Denis | 297/6 |
| 2,866,495 | A * | 12/1958 | Diehl et al. | 297/6 |
| 3,256,035 | A | 6/1966 | Garringer | |
| 3,516,425 | A * | 6/1970 | Rigal | 135/67 |
| 5,005,599 | A * | 4/1991 | Cunningham | 135/67 |
| 5,158,313 | A | 10/1992 | Becker | |
| 5,172,715 | A | 12/1992 | Webb | |
| 5,405,187 | A * | 4/1995 | Soderlund | 297/312 |
| 5,702,326 | A * | 12/1997 | Renteria | 482/68 |
| 5,882,067 | A | 3/1999 | Carbajal et al. | |
| 5,979,476 | A * | 11/1999 | Cranny | 135/67 |
| 6,296,263 | B1 | 10/2001 | Schultz et al. | |
| 6,311,708 | B1 | 11/2001 | Howle | |
| 6,338,493 | B1 * | 1/2002 | Wohlgemuth et al. | 280/30 |
| 6,595,530 | B2 * | 7/2003 | Wood | 280/42 |
| 6,974,142 | B1 * | 12/2005 | Shikinami et al. | 280/250.1 |
| 7,108,004 | B2 | 9/2006 | Cowie et al. | |

(Continued)

OTHER PUBLICATIONS

Merry Walker Corporation; http://www.merrywalker.com; Oct. 16, 2008; 1 page.

(Continued)

*Primary Examiner* — Noah Chandler Hawk
(74) *Attorney, Agent, or Firm* — Weide & Miller, Ltd.

(57) ABSTRACT

A physical assistance device is configured as a walking aid and to support a user in a seated position. The physical assistance device has a frame including a pair of spaced front legs and a pair of spaced rear legs and defining a front and a rear and an interior area in which a user may stand when walking when facing the front of the physical assistance device. The physical assistance device also comprises a seat connected to the frame, the seat movable between a seating position in which it is positioned at the interior area at the rear of the physical assistance device with a seating surface thereof facing the front of the physical assistance device, whereby a user may sit upon the seating surface while still facing the front of the physical assistance device, and a retracted position.

12 Claims, 7 Drawing Sheets

(56) References Cited

U.S. PATENT DOCUMENTS

| | | | | |
|---|---|---|---|---|
| 8,156,581 | B2 * | 4/2012 | Fogleman | 5/83.1 |
| 2003/0070702 | A1 | 4/2003 | Ownes | |
| 2005/0183759 | A1 * | 8/2005 | Wolfe | 135/67 |
| 2006/0261569 | A1 * | 11/2006 | Delhotal | 280/87.021 |

OTHER PUBLICATIONS

InvaCare Corporation; http://www.invacare.com/product_files/65650_400_Arev.jpg; Oct. 20, 2008; 1 page.
InvaCare Corporation; http://www.invacare.com/product_files/65450_400_B.jpg; Oct. 20, 2008; 1 page.
InvaCare Corporation; http://www.invacare.com/product_files/65100R_400_A.jpg; Oct. 20, 2008; 1 page.
InvaCare Corporation; http://www.invacare.com/product_files/Knee-Walker_65950-400.gif; Oct. 20, 2008; 1 page.
Author unknown; http://images.allegrocetnral.com, Oct. 20, 2008; 1 page.
The Medical Supply Depot; http://www.themedicalsupplydepot.com/ProductImages/main2/10221.jpg; Oct. 20, 2008; 1 page.
The Medical Supply Depot; http://www.themedicalsupplydepot.com/ProductImages/main/DMKA%201200.jpg Oct. 20, 2008; 1 page.
The Medical Supply Depot; http://www.themedicalsupplydepot.com/ProductImages/main2/PE%201000.jpg; Oct. 20, 2008; 1 page.
The Medical Supply Depot; http://www.themedicalsupplydepot.com/ProductImages/main2/PE%201200.jpg; Oct. 20, 2008; 1 page.
Preferred Health Choice; http://www.phc-online.com/v/vspfiles/photos/Crocodile-Gait-Trainer-2.jpg; Oct. 20, 2008; 1 page.
Preferred Health Choice; http://www.phc-online.com/v/vspfiles/photos/Comet-2100-2.jpg; Oct. 20, 2008; 1 page.

* cited by examiner

PHYSICAL ASSISTANCE DEVICE CONFIGURABLE INTO A WALKER/ROLLATOR, SEAT OR TRANSPORT CHAIR

RELATED APPLICATION DATA

This application is a continuation-in-part of U.S. application Ser. No. 12/655,060, filed Dec. 21, 2009, which claims priority to U.S. Provisional Patent Application Ser. No. 61/203,872, filed Dec. 29, 2008.

FIELD OF THE INVENTION

The present invention relates to walking, seating and transport aids.

BACKGROUND OF THE INVENTION

Many people suffer from ailments or injuries which make it difficult for them to walk unaided. If the ailment or injury is sufficiently severe, the person may be confined to a wheelchair.

However, in many other instances, the person merely needs a walking aid. One such aid is a cane. Canes do not offer a great deal of stability, however, and they can be difficult to use.

A common walking aid that provides greater stability is the walker. Walkers generally comprise a frame or structure having two or more points of contact with the ground. The walker is designed to extend across the front of the user for engagement by both hands of the user. In this manner, the user is provided side-to-side stability. In addition, the user can lean down on the walker for support in standing. To allow a user to more easily move a walker with them, walkers are often supported by wheels. In such a configuration, a walker is commonly referred to as a "rollator".

Sometimes a user of a walker needs to sit down to rest. This is relatively convenient if the user is close to a seating surface such as a chair in the home. However, a chair or the like may not be available, or the user may not have the strength to travel to the seat.

As one attempt to solve this problem, some walkers include a seating element. However, to provide support for the seat and/or make the walker usable when the user is not seated, the seats of such walkers all have very disadvantageous configurations. Most commonly, walkers which include seats have their seats located at the front of the walker facing rearwardly. When a user desires to switch between walking and sitting, this requires that the user attempt to turn around to sit down. When the user attempts to turn around, however, they lose the support of the walker. This often results in the user falling down and risking further injury, which is contrary to the original purpose of the walker for seating purposes.

SUMMARY OF THE INVENTION

One aspect of the invention is a physical assistance device which may be configured as a walking aid and also support a user in a seated position. In one embodiment, the physical assistance device comprises a frame which includes a plurality of supporting legs, such as a pair of spaced front legs and a pair of spaced rear legs. The physical assistance device preferably has a front and a rear and an interior area defined by the frame between the spaced front and rear legs in which a user may stand when walking when facing the front of the physical assistance device.

The physical assistance device preferably also comprises a seat connected to the frame of the physical assistance device. The seat is movable between a seated position in which the seat is positioned at the interior area at the rear of the physical assistance device with a seating surface thereof facing the front of the physical assistance device, whereby a user may sit upon the seating surface while still facing the front of the physical assistance device, and a retracted position in which the seat does not prevent access to the interior area of the physical assistance device at the rear thereof. In one embodiment, the physical assistance device may include one or more handles configured so that when the physical assistance device is used in its seated position, it may be used as a transport chair.

In one embodiment, the seat comprises first and second seat portions supported by the frame. The first and second seat portions may be rotatably mounted to the frame, permitting the first and second seat portions to rotate between the seated position and the retracted position.

The front and rear pairs of legs, or front and rear portions of the frame including those legs, may be hingedly connected, permitting the physical assistance device to be moved between a collapsed and extended position. In addition, the legs may be supported by one or more wheels, swivel wheels or casters, permitting the physical assistance device to roll or turn.

In one embodiment, a seat control is provided which allows the user to control the position of the seat. The seat control may comprise a control which causes the seat to move from the retracted position to the seated position while the user is facing the front of the physical assistance device. Use of the same control or release of that control may cause or allow the seat to move back to its retracted position. The control may comprise a lever mounted to the handle(s) of the physical assistance device, the lever connected to the seat by a cable or the like.

Further objects, features, and advantages of the present invention over the prior art will become apparent from the detailed description of the drawings which follows, when considered with the attached figures.

DETAILED DESCRIPTION OF THE INVENTION

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a user physical assistance device. The user assistance device is conveniently referred to herein as a walker/rollator in that one purpose thereof is to provide support to a user when the user is walking. As detailed herein, the physical assistance device is also preferably configured to support a user at one or more times in a seated, stationary position. As detailed, in such a position the physical assistance device may be used for simple seated support or may be used as a transport chair, such as to be rolled/guided by another party.

Figure 1:
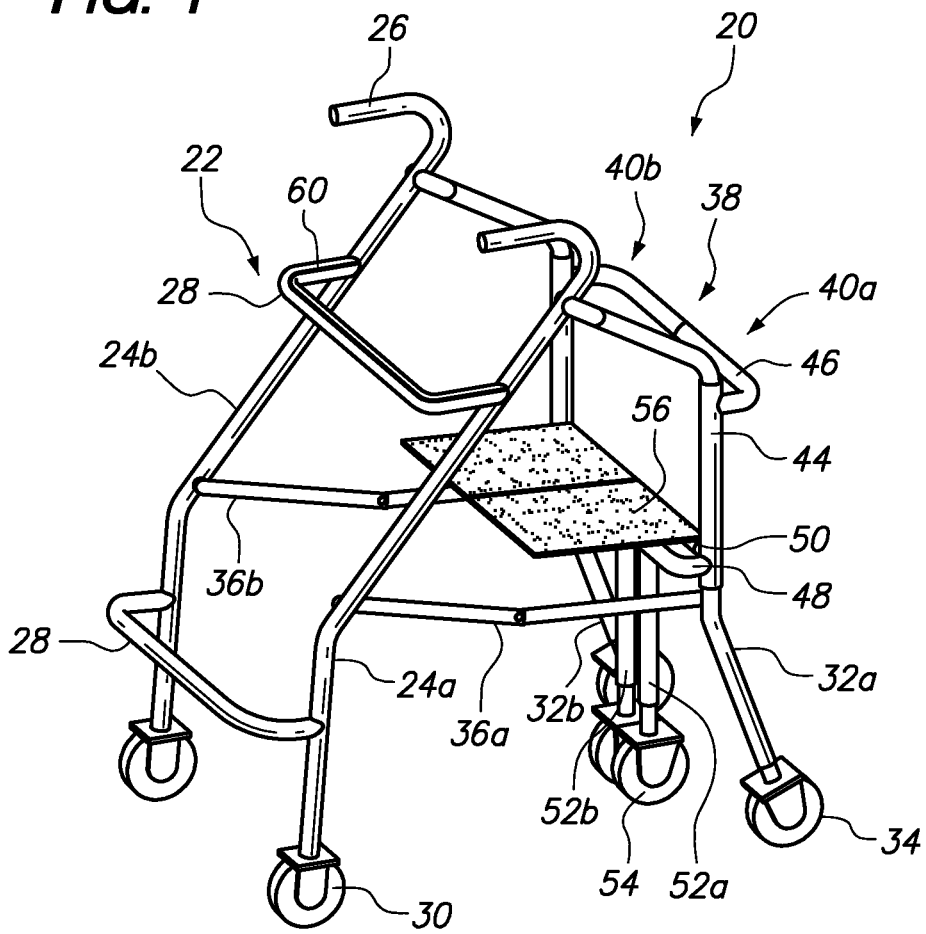
FIG. 1 is a perspective view of a physical assistance device of the invention with a seat portion thereof illustrated in a use position.

FIG. 1 illustrates one embodiment of a physical assistance device 20 in accordance with the present invention. In one embodiment, the physical assistance device 20 comprises a frame 22. The configuration of the frame 22 may vary. Preferably, the frame 22 is supported by at least two, more preferably three, and most preferably, at least four supports. As illustrated, the frame 22 comprises first and second (or left and right) front legs 24*a,b*.

Figure 5:
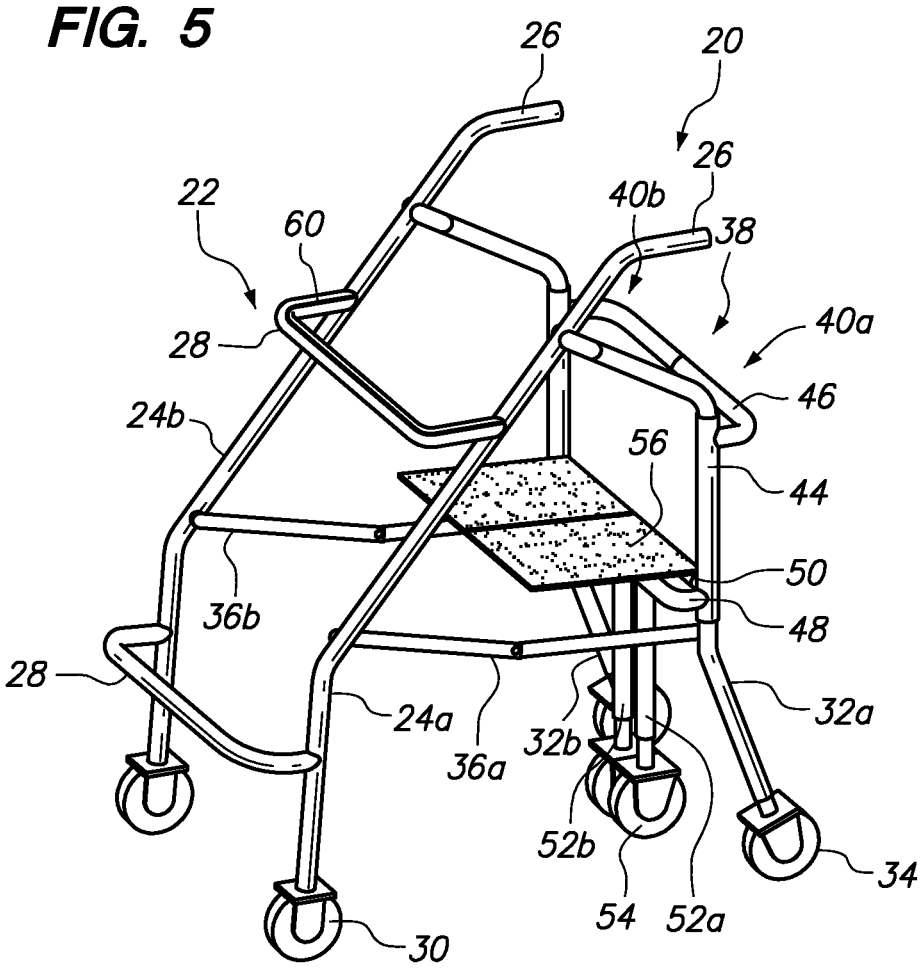
FIG. 5 is a perspective view of the physical assistance device illustrated in FIG. 1 configured as a transport chair.

In one embodiment, the physical assistance device 20 includes one or more handles 26. For example, a handle 26 may be located at the top of each front leg 24*a,b*. The handle 26 may be connected to each front leg 24*a,b*, or as illustrated, be defined thereby. In the preferred embodiment, each handle 26 is located at a top portion of each front leg 24*a,b*, though they could be in other locations. The handles 24*a,b* may be oriented in various directions. As detailed herein, the handles 26 could face forward, as illustrated in FIG. 1, or rearward, as illustrated in FIG. 5. As indicated herein, the positions of the handles 26 may be changeable, such as depending upon the desired configuration of the physical assistance device 20.

The front legs 24*a,b* are spaced from one another. This spacing may vary, including depending upon the size of the user for which the physical assistance device 20 is intended. Preferably, the spacing causes the front legs 24*a,b* to be located approximately even to a user's shoulders/arms. One or more struts 28 may extend between the front legs 24*a,b*, thus securely connecting them into their desired spacing/location. For example, as illustrated, one strut 28 may be located near the top of the front legs 24*a,b* below the handles 26, and another strut may be located near the bottom of the legs 24*a,b*. Of course, the number of struts, their orientation and shape may vary.

In one embodiment, a wheel 30 is located at the bottom of each front leg 24*a,b*. The wheel 30 may be of a variety of types, such as simple axle, caster, swivel or the like. Further, the wheel may comprise a single wheel or multiple wheels. In other embodiments, the front legs 24*a,b* might also simply terminate (i.e. have an end without a wheel) or have a surface contacting foot or other element located at the end thereof.

As illustrated, the front legs 24*a,b* may extend upwardly from their bottom ends generally vertically, and then slope rearwardly towards their top ends. In this manner, when a user is engaging the handles 26 and they move their feet forwardly to walk, their feet do not impact the physical assistance device. In addition, as detailed below, the spacing of the front wheels 30 from rear wheels (detailed below) provides support to the physical assistance device 20.

Figure 2:
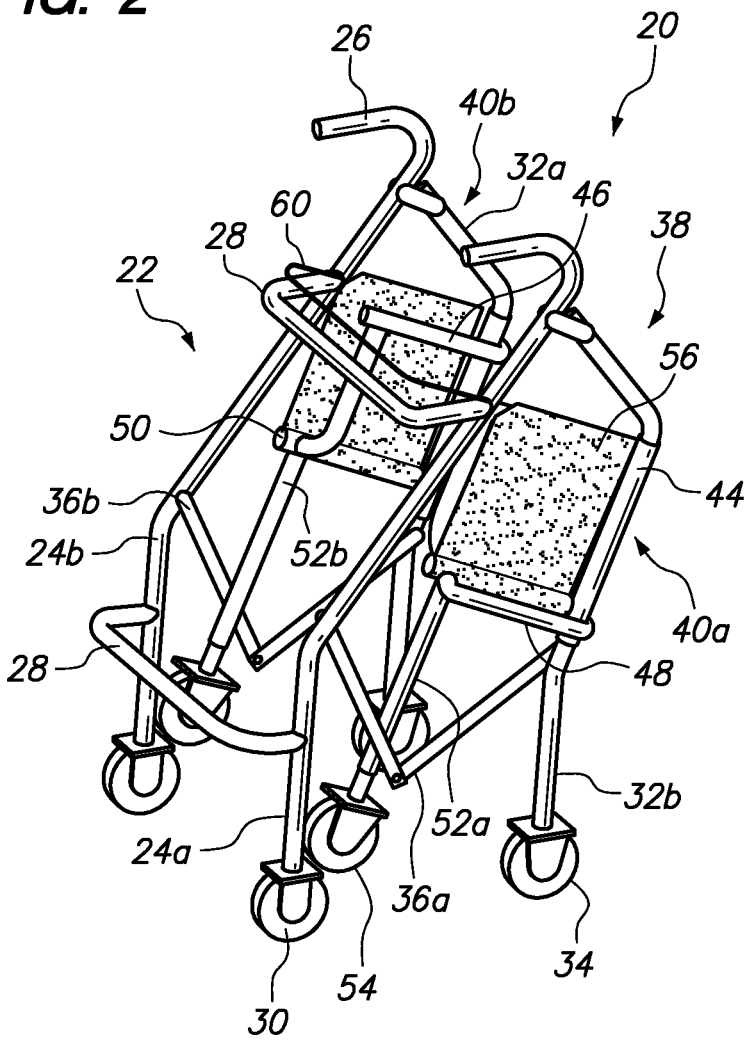
FIG. 2 is a perspective view of the physical assistance device illustrated in FIG. 1 in a folded position.

In one embodiment, the physical assistance device 20 also comprises a pair of rear legs 32*a,b* (i.e. first and second or right and left rear legs). In one embodiment, each rear leg 32*a,b* is attached to its corresponding front leg 24*a,b*, such as at a top end or portion of the rear leg 32*a,b*. As illustrated, this connection may be near the top of the front legs 24*a,b* beneath the handles 26. In addition, as illustrated in FIG. 2, the front and rear legs may be rotatably or hingedly connected, such as via a hinge, thereby permitting the rear legs 32*a,b* to be folded inwardly towards the front legs 24*a,b*, in the manner detailed below.

So configured, the physical assistance device 20 generally has a pair of sides, a front and a rear. The front is generally closed, such as via the struts 28, while the rear is generally open. The frame of the physical assistance device 20 generally defines an interior area between the front and rear legs 24*a,b* and 32*a,b* from front to back, and by the pairs of legs at the sides. Because the rear of the physical assistance device 20 is generally open, a user can walk into the interior area of the physical assistance device 20 from the rear thereof. At that time, the user is generally located within the frame of the physical assistance device 20, thus providing stability to the user in both the front-to-rear and side-to-side directions.

Once again, a wheel 34 may be located at the bottom or second end of each of the rear legs 32*a,b*. The type and/or number of wheels 34 may again vary. Further, the wheels 34 could be replaced with feet or other elements.

When both the front and rear legs are fitted with wheels 30,34, the physical assistance device 20 includes a pair of front wheels and a pair of rear wheels. These pairs of wheels rotatably support the physical assistance device. It will be appreciated that if the physical assistance device does not include wheels and is used to aid a user in walking, it may be simply referred to as a "walker". However, if the physical assistance device includes wheels and is used to aid a user in walking, it may be referred to as a "rollator", in accordance with the common parlance of these terms.

One or more of the wheels 30,34 may include a braking or locking mechanism, such as to prevent the physical assistance device 20 from rolling away. Alternatively, a separate braking mechanism may be provided, such as a foot or the like which may be supported by the frame 22 and placed into engagement with a support surface.

As illustrated, the rear legs 32*a,b* may extend rearwardly from the front legs 24*a,b* and then downwardly, and then rearwardly again. In this manner, the front and rear wheels 30,34 are spaced from one another from the front to the rear of the physical assistance device 20, thus serving to provide substantial front to back stability to the physical assistance device 20.

To provide further support, side struts 36*a,b* may extend between the corresponding pairs of front and rear legs. In particular, a first side strut 36*a* may extend between the left side front and rear legs 24*a*,32*a* and a second side strut 36*b* may extend between the right side front and rear legs 24*b*,32*b*. As illustrated, these side struts 36*a,b* may be located approximately midway along the length of the legs. In order to permit folding or collapsing of the physical assistance device 20, each side strut may comprise first and second members which are rotatably or hingedly connected.

Most importantly, the physical assistance device 20 also comprises at least one seat 38. Preferably, the seat 38 is mounted to or supported by the frame 22 of the physical assistance device 20 and is configured to be forward-facing so that a user can transition from standing to sitting and sitting to standing without having to turn around or otherwise change directions relative to the physical assistance device. At the same time, the seat 38 is preferably configured so that it does not impede the user's use of the physical assistance device as a walking aid.

In one embodiment, the seat 38 comprises a first seat portion 40*a* and a second seat portion 40*b*. In one embodiment, each seat portion comprises a seat frame and a seat surface. As illustrated, each seat frame comprises a mounting portion 44 which is preferably connected to one of the rear legs 32*a,b*. The mounting portion 44 is preferably rotatably mounted to its corresponding rear leg. In one embodiment, the mounting portion 44 may comprise a tube or sleeve which extends around the generally vertical middle portion of its corresponding rear leg 32*a,b*.

Each seat frame also preferably comprises a three horizontal supports 46,48,50. A first of the supports 46 may extend outwardly from near the top of the mounting portion 44. The second and third supports 48,50 may extend outwardly below the first, such as from near the bottom of the mounting portion 44.

Figure 3:
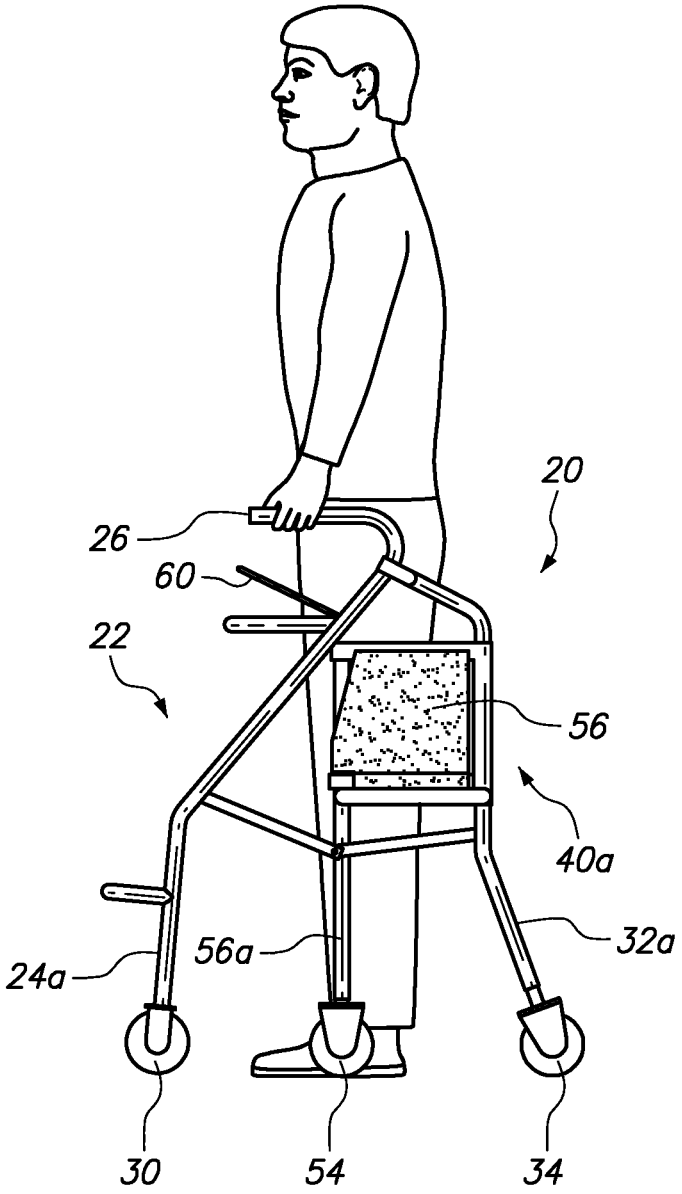
FIG. 3 is a side elevation view of a physical assistance device of the invention with a seat portion thereof in a retracted position and a user engaging the physical assistance device in a walking position.

In one embodiment, each seat portion 40*a,b* also comprises a corresponding seat leg 52*a,b*. In one embodiment, each seat leg 52*a,b* extends downwardly from the top horizontal support 48 and engages the second and third lower supports 48,50, before extending to a wheel 54 (again, the configuration of the wheel or wheels may vary). As illustrated in FIGS. 1 and 3, these wheels 54 may provide additional support to the physical assistance device (i.e. six or more supports in the walking and/or seating position). In one embodiment, the wheels 54 may be slightly elevated above the other wheels 30,34 during use of the physical assistance device 20 as a walker/rollator, whereby the wheels 54 do not increase the drag of the device. However, when the physical assistance device 20 is used in the seating position, the weight of the user may cause then wheels 54 to come into contact with a support surface, thereby providing additional support.

As indicated, each seat portion 40*a,b* includes a seat support 56. In one embodiment, each seat support 56 is a generally planar support or body. As illustrated, the seat support 56 may be mounted to the second horizontal support 50 for rotating movement between a raised or vertical position and a lowered or horizontal position. In the horizontal position, the seat support 56 may be partly supported by the third or lower support 48 of the seat frame.

In a preferred embodiment, the various portions of the physical assistance device 20 are constructed from durable materials. For example, the legs, supports and struts may be constructed from metal tubing or bars. The seat supports may be constructed from molded plastic and/or be padded. The various portions of the physical assistance device might be painted or other surface ornamentation might be applied thereto. Further, rubber or foam grips or the like may be applied to the various portions thereof to aid the user in holding or gripping the physical assistance device.

The physical assistance device may include additional features such as brakes, height adjustment (such as a height adjustment for each leg or for the handles) or the like. For example, when the device includes wheels which permit the device to be used as a rollator, the device may include a brake or brakes. The at least one brake or braking mechanism may be used to maintain the device in a static position for periods of time. Such a brake may be manually engageable by a user, or might be automatically engaged and then be manually disengaged by the user (for example, a user may be required to disengage the brake, such as by operation of a lever, whenever the user wishes to roll the device). Such one or more brakes might be associated with one or more of the wheels of the device or might be supported by the frame and be independent of the wheels (i.e. be configured to brake one or more of the wheels or be configured to directly contact a support surface). Brake levers or other controls might be located in various positions, such as at one or both handles 126.

Additional aspects of the physical assistance device will be appreciated from the method of use and operation thereof.

Referring to FIG. 2, a user may store the physical assistance device 20 when it is not in use. At such time, the front and rear legs 24*a,b* and 32*a,b* may be folded or collapsed towards one another. This is facilitating by folding of the side struts 36*a,b* and by rotation of the rear legs 32*a,b* relative to the front legs 24*a,b*. In this manner, the profile or size of the physical assistance device 20 is reduced, such as for storage in a closet, for transport in the trunk of a car or the like.

Referring to FIG. 3, a user may utilize the physical assistance device 20 as a walking aid. At that time, the front legs 24*a,b* and the rear legs 32*a,b* are separated from one another and the side struts 36*a,b* are extended. In one embodiment, the side struts 36*a,b* may include a locking mechanism to lock the hinge thereof into a locked or fixed position, thereby maintaining the front and rear legs in their separated positions.

At this time, each seat portion 40*a,b* is preferably rotated to a first, retracted position, as illustrated in FIG. 3. At this time, the seat supports 56 are folded vertically up. The first seat portion 40*a* is rotated so that it is positioned outside of the first or left side of the physical assistance device 20 at the outside of the left side front and rear legs 24*a*,32*a*. The second set portion 40*b* is similarly rotated so that it is positioned outside of the second or right side of the physical assistance device 20 at the outside of the right side front and rear legs 24*b*,32*b*. When the seat portions 40*a,b* are in this position, they are spaced from one another and preferably do not obscure the rear portion of the physical assistance device, thus permitting the user to enter the rear of the physical assistance device 20.

The user faces the front of the physical assistance device 20 and grips the handles 26. The user can then walk forward with the support of the physical assistance device (the physical assistance device can conveniently roll on its wheels 30,34 as the user moves).

Figure 4:
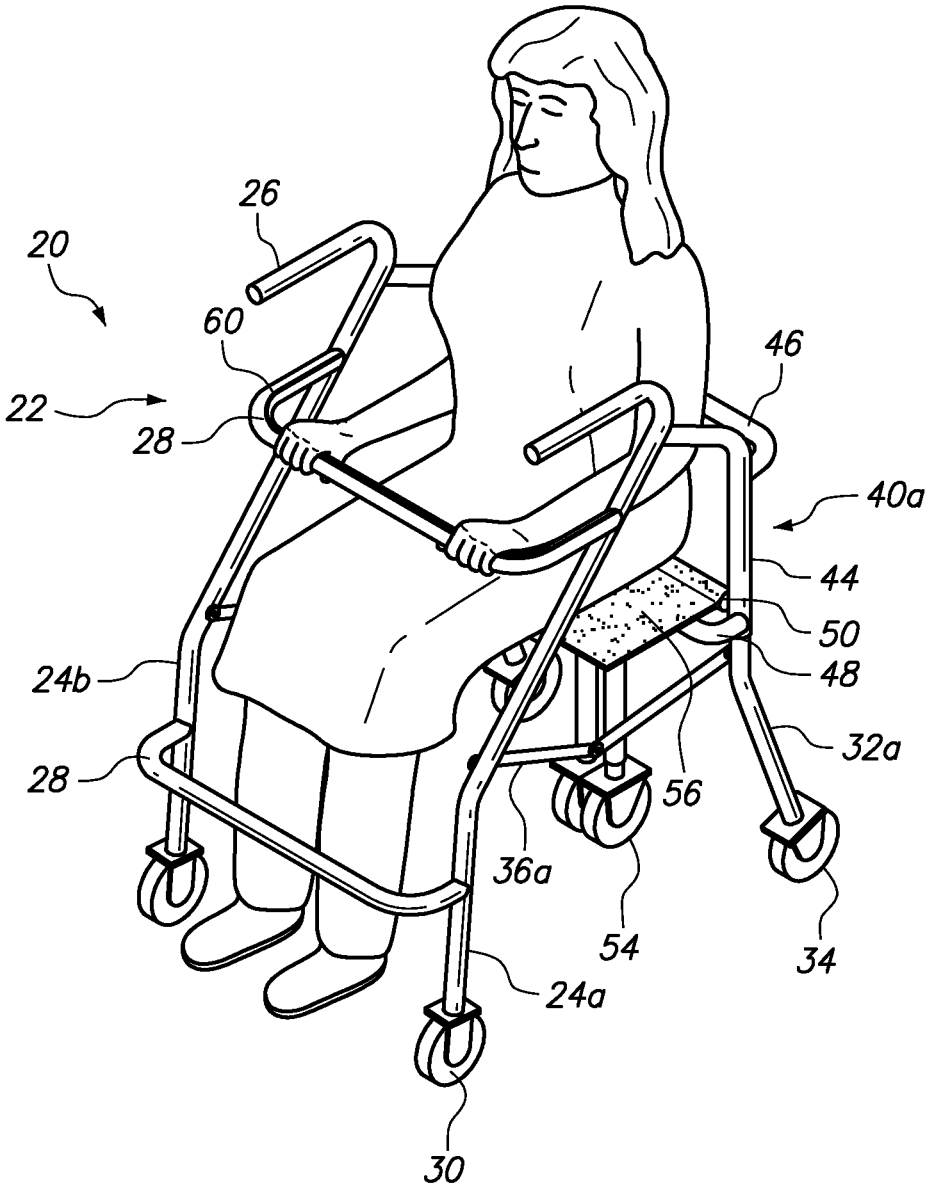
FIG. 4 is a perspective view of the physical assistance device illustrated in FIG. 1 with a seat thereof in a use position and a user seated in the seat.

The user may also be supported by the physical assistance device 20 in a seated position. At this time, the user rotates the seat portions 40*a,b* into a second user or seated/seating position, as illustrated in FIGS. 1 and 4. As illustrated, when the seat portions 40*a,b* are moved into this position, they are moved proximate to one another, whereby the first or top supports 46 thereof combine to form a seat back.

The user moves the seat supports 56 downwardly. So rotated, the seat supports 56 are supported by the lower or third supports 50 of the seat portions 40*a,b*. The seat supports 56 are located adjacent to one another, thus forming a unitary seat. Notably, when the two seat portions 40*a,b* are rotated into their engaged position, the seat essentially spans the entire rear of the physical assistance device 20, thus providing a wide and stable seating area.

As also illustrated, at this time the seat legs 52*a,b* are rotated into an engaged position. In particular, the seat legs 52*a,b* extend under the seat to provide added support thereto.

Most importantly, the seat of the physical assistance device is configured so that it faces forwardly. Thus, when a user wishes to transition between walking to sitting, or sitting back to walking, the user does not need to turn around. Instead, when the user is walking and wishes to sit, the user may merely position the seat and then sit down into the seat while still facing forward. Likewise, in order to walk, the user simply stands up and moves the seat out to its retracted position. This is accomplished while the user remains facing forward.

In one embodiment, movement of the seat between its seated and retracted positions may be automated. For example, in one embodiment, the seat portions 40*a,b* may be biased to their first, retracted position. This may be accomplished with springs or other members which bias the seat portions 40*a,b*, causing them to rotate around to their retracted positions as illustrated in FIG. 3.

A seat control may be utilized for moving the seat to its engaged position. For example, a moveable grip, lever or bar 60 may be mounted to the physical assistance device 20, such as adjacent the top-most strut 28 (as illustrated in FIGS. 3 and 4). The seat control may be linked to the seat portions 40*a,b*, such as with one or more cables. Movement of the seat control, such as rotation of the grip or compression of the lever or bar 60, may pull the one or more cables, thus pulling the seat portions 40*a,b* into their engaged positions as illustrated in FIG. 4. The seat portions 40*a,b* may remain in that position until the seat control is released. In another embodiment, once the seat portions 40*a,b* are moved into their engaged position, they may be retained in that position with a user-controlled lock until the user is done using the seat. At that time, the user may release the lock, whereupon the biasing mechanism may move the seat portions 40*a,b* back to their retracted positions.

In one embodiment, the physical assistance device 20 may include a locking device to securely connect the seat portions 40*a,b* when the seat is moved into its engaged position. A wide range of means may be used to secure, lock or otherwise connect the seat portions 40*a,b* together. For example, a latch may be connected between the first supports 46 or the seat supports 56 of the seat portions 40*a,b*. In another embodiment, the first supports 46 or the seat supports 56 might comprise mating protections and detents that selectively engage one another. As one example, one seat portion 56 might have a protection or lock that can swivel outwardly into engagement with a slot in the other seat portion 56. So connected with such a lock, the seat portions 40*a,b* are preferably prevented from rotating or moving out of position without being unlocked first.

In one embodiment, the physical assistance device 20 of the present invention may be used as a transport chair. Namely, the physical assistance device may be configured to both support a user in a seated position and permit an operator to move or control the transport chair. For example, in one embodiment, the handles 26 may be elongated and rotatable. Thus, when the physical assistance device 20 is being used to support a user in a seated position, as illustrated in FIG. 5, the handles 26 may be rotated into a reverse position in which they extend rearwardly (instead of forwardly, as illustrated in FIG. 1). This would allow another party to stand behind the physical assistance device and grasp the handles 26 to push and/or steer the physical assistance device. In another embodiment, the physical assistance device might include an additional handle or handles (i.e. secondary to the handles 26), such as a set of handles extending from the first seat supports 46 that might be grasped by a user. Such handles might be retractable or otherwise move between a position in which they extend outwardly for use and a retracted position during non-use (so that they do not protrude from the physical assistance device undesirably).

Figure 6:
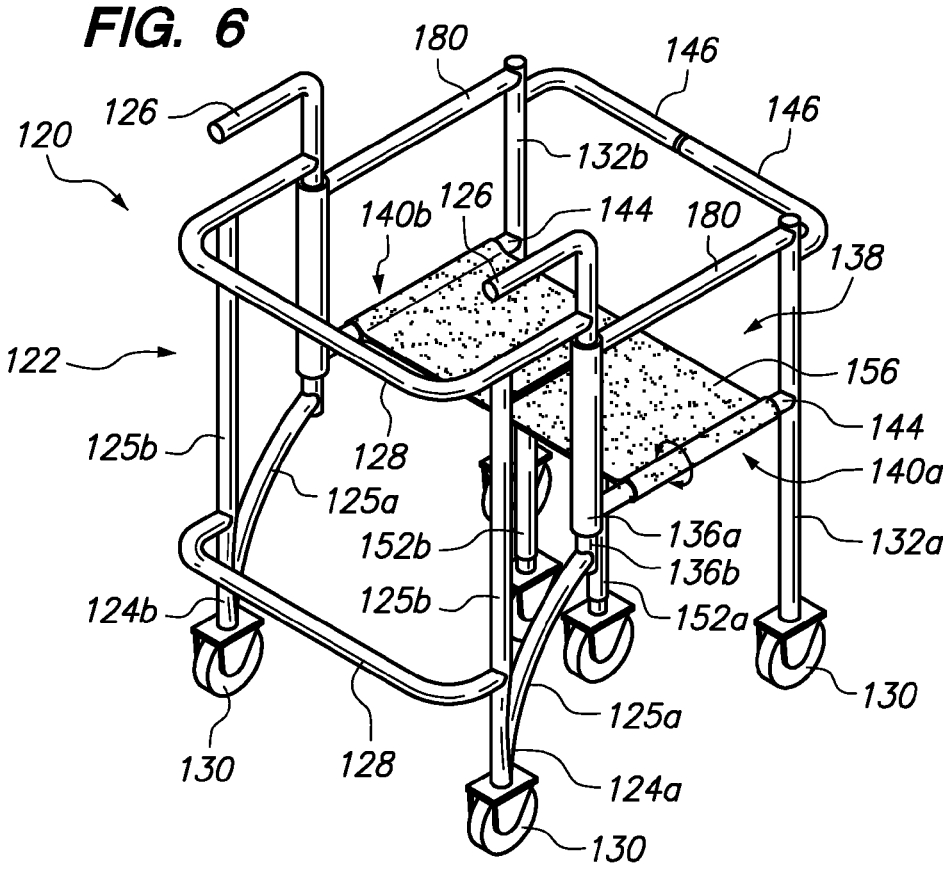
FIG. 6 is a perspective view of a physical assistance device in accordance with another embodiment of the invention, the device illustrated with a seat portion thereof in a use position.
Figure 7:
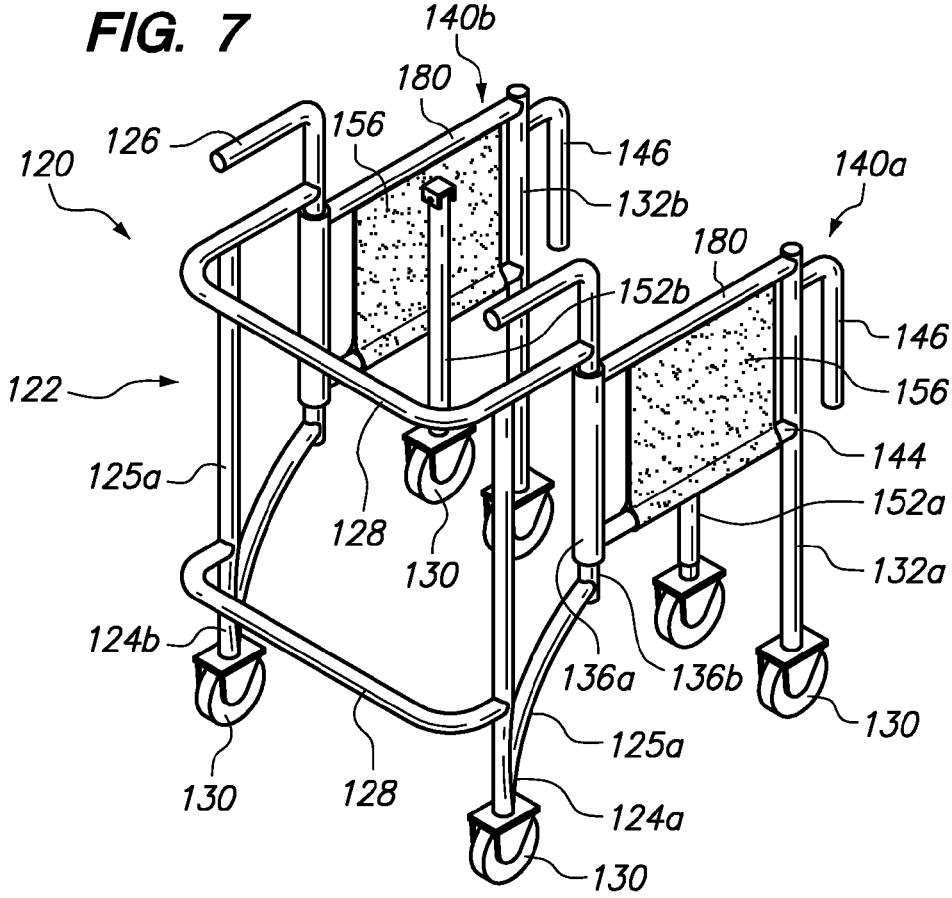
FIG. 7 is a perspective view of the physical assistance device illustrated in FIG. 6 with a seat portion thereof in a retracted position.
Figure 8:
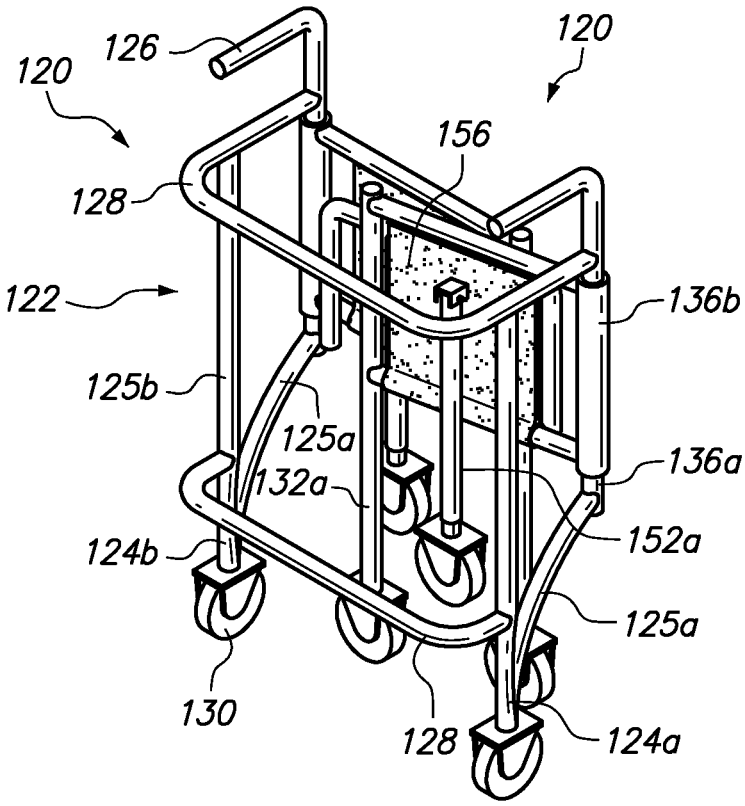
FIG. 8 is a perspective view of the physical assistance device illustrated in FIG. 6 in a folded position.

FIGS. 6-8 illustrate another embodiment of a physical assistance device 120 in accordance with the invention. In description and illustration of this embodiment, like reference numbers have been assigned to like elements to those of the first embodiment illustrated in FIGS. 1-5, except that a "100" level designation has been assigned thereto.

Once again, the physical assistance device 120 comprises a frame 122. Again, the frame 122 may have various configurations. Like the first embodiment, in this embodiment the physical assistance device 120 generally has a front portion and a rear portion. The front portion primarily comprises a pair of front legs 124*a,b* and one or more struts 128 (and in preferred embodiments, one or more additional elements such as handles). Like the first embodiment, in this embodiment the rear portion generally comprises a pair of rear portions, each portion comprising a rear leg 132*a,b* and an associated seat portion 140*a,b*.

As indicated, the frame 122 preferably comprises a pair of front legs 124*a,b*. The front legs 124*a,b* are spaced from one another and generally located towards a front of the physical assistance device 120. As with the first embodiment, the frame 122 preferably also includes one or more struts 128, such as an upper strut and a lower strut. These struts generally span the front of the physical assistance device 120 connecting the front legs 124*a,b*.

In one embodiment, the front legs 124*a,b* have a main bottom portion and then split into a pair of leg portions or supports 125*a,b*. A first of the leg portions 125*a* may, as illustrated, extend generally vertically upward. The bottom strut 128 may connect those first leg portions 125*a* and the top strut 128 may be supported by those first leg portions 125*a*. The second leg portions 125*b* may diverge towards the rear of the frame 122, such as connecting to corresponding second hinge member 136*b*, as described in greater detailed below.

In one embodiment, so that the physical assistance device 120 may be used as a rollator, at least one wheel 130 is preferably located at the bottom of each front leg 124*a,b*. Again, the configuration of the at least one wheel 130 may vary.

As indicated, the rear portion of the frame 122 includes a pair of rear legs 132*a,b*. Again, these legs may be fitted with one or more wheels 130. In this manner, the entire physical assistance device 120 may be rollably supported, such as for use as a rollator.

Once again, the physical assistance device 120 preferably includes at least one seat 138. Preferably, the seat 138 is mounted to the frame 122 of the physical assistance device 120 and is again configured to support a user in a forward-facing position (i.e. towards a front of the device 120).

In one embodiment, the seat 138 is associated with the rear portion of the physical assistance device 120. As with the first embodiment, in this embodiment the seat 138 comprises a first seat portion 140*a* and a second seat portion 140*b*. Each seat portion 140*a,b* again comprises a seat frame and a seat surface. Each seat frame may comprise a mounting arm or strut 144. As illustrated, in one embodiment the mounting arm 144 extends generally horizontally between its corresponding rear leg 132*a,b* and a first hinge member 136*a*.

In one embodiment, each seat portion 140*a,b* has a corresponding seat support or surface 156. In one embodiment, each seat surface 156 is configured to rotate about its mounting arm 144. In one embodiment, each seat surface 156 is configured to move between an upright or "stowed" position as illustrated in FIG. 7, to an extended or "use" position as illustrated in FIG. 6, as described in more detail below. As with the first embodiment, in this configuration first and second seat surfaces 156 cooperate to define a seat for a user. In one embodiment, the seat surfaces 156 may be configured to lock or inter-engage when they are in their extended position to form a generally unitary seat.

Of course, the seat might have other configurations, such as comprising a singular member or one or more members which move, extend or otherwise define a seating surface at one or more times. The one or more seat surfaces 156 may have various shapes, such as the generally square shape illustrated or others. The one or more seat surfaces 156 may be constructed from various materials, such as metal or molded plastic. If the seat surfaces 156 are constructed of plastic, they may include ribbing or other features or elements for increasing the rigidity and load-bearing capacity thereof. Of course, the top of each seat surface 156 might be cushioned for user comfort.

Each seat portion 140*a,b* may include a seat back 146. The seat back 146 may comprise a bar that is configured to be moved between a retracted position as illustrated in FIG. 7 and an extended position as illustrated in FIG. 6. Each seat back 146 may be mounted for rotation to one of the rear legs 132*a,b*. For example, in the retracted position as illustrated in FIG. 7, each seat back 146 may extend generally vertically along its corresponding leg 132*a,b*. In its extended position, as illustrated in FIG. 6, each seat back 146 may extend generally horizontally inward. Preferably, the seat backs 146 are positioned above the seat portions 146, such as at a height that they engage the back of a user who is seated upon the seat supports 156. As with the seat surfaces 156, the seat backs 146 may be configured so that they meet or otherwise cooperate to define a relatively contiguous support when they are in their extended positions, as best illustrated in FIG. 6. Of course, the seat back or backs might have other configurations, such as comprising a single element, one or more elements movable or mounted in other fashions, and having other shapes or configurations for engaging a user. For example, the seat backs 146 may include generally planar back-engaging sections and/or cushions.

The seat surfaces 156 may be supported in various fashions. In one embodiment, each seat surface 156 may be mounted on or include a sleeve which rotates about or relative to its corresponding mount 144. Such a sleeve might include a stop which prevents the seat surface 156 from rotating past horizontal and thus securely supporting the seat in the position illustrated in FIG. 6. In one embodiment, the stop might comprise a flange which extends outwardly in the opposing direction from the main portion of the seat surface 156 (i.e. towards the exterior of the physical assistance device 120 rather than the interior thereof) and engage a stop (not shown) of the frame 122, the flange engaging the stop in a manner which prevents over-rotation of the seat surface 156 and maintains the seat surface 156 in its horizontal use position. Further, as detailed above, the seat surfaces may be configured to engage or lock together when they are in their engaged position.

However, other supports may be provided for the seat surfaces 156. Such might comprise frame members which extend outwardly from the mounts 144 or rear legs 132*a,b* to support the seat surfaces 156 when they are moved to their extended positions as illustrated in FIG. 6. In a preferred embodiment, as best illustrated in FIG. 7, each seat surface 156 may be configured to be supported by a seat leg 152*a,b*. In this embodiment, the seat legs 152*a,b* may be directly associated with the seat surfaces 156 or their associated mounts. For example, each seat leg 152*a,b* may have a top end located at a bottom or underside of its corresponding seat surface 156.

Figure 9A:
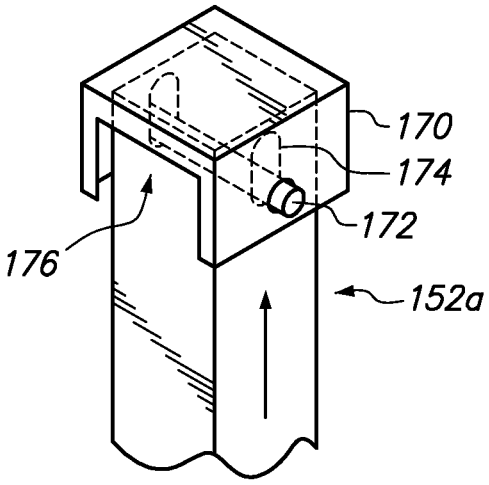
FIG. 9*a* is a perspective view of a seat support in a use position.
Figure 9B:
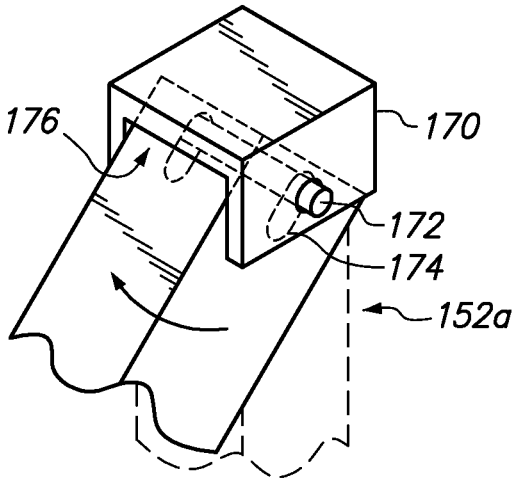
FIG. 9*b* illustrates movement of the seat support from the use position as illustrated in FIG. 9*a* to a retracted position.

As illustrated in FIGS. 9*a* and 9*b*, the seat legs 152*a,b* may be configured to move between an extended position and a retracted position. A description of a preferred embodiment of this connection will be described relative to one of the legs 152*a*, it being understood that a similar connection is preferably utilized for the other leg 152*b*.

As illustrated, a leg mount or base 170 may be located at the bottom of underside of the seat support 156. A top end of the seat leg 152*a* is located in an interior of its respective base 170. In one embodiment, the base 170 supports a cross-pin 172. The pin 172 extends through a slot 174 in the leg 152*a*. The slot 174 is preferably elongate, permitting the position of the leg 152*a* to change relative to the pin 172.

Referring to FIG. 9*a*, when a seat support 156 is in use, the leg 152*a* slides downwardly (relative to the pin 172) until the top end of the leg 152*a* abuts the base 170. In this position, the top end of the leg 152*a* serves as a distributed contact surface for downward forces from the seat support 156.

Referring to FIG. 9*b*, the base 170 preferably has at least one opening 176. When the seat portion 156 is moved from its use position to its stowed position, the pin 172 slides upwardly along the slot 174 in the leg 152*a*, allowing the top of the leg 152*a* to move out of contact with the base 170. At this time, the leg 152*a* can rotate about the pin 172 and through the opening 176 in the base 170 to a generally perpendicular position. In this position, the leg 152*a* is retracted and extends generally parallel to the seat portion 156 (as illustrated in FIG. 7).

In the illustrated configuration, the leg 152*a* and the associated base 170 are generally square in shape. They might be other shapes, however, such as round. Also, while a preferred embodiment of the connection for the seat legs 156*a,b* has been described, other connections are possible.

The frame 122 may include various other elements. Referring to FIG. 6, a pair of supports 180 may extend from the rear legs 132*a,b* to a corresponding second hinge member 136*b*. These supports 180 may be located above the mounts 144 for the seat supports 156, such as to provide additional rigidity and strength to the frame 122.

Also, the frame 122 may include one or more handles 126. In one embodiment, first and second handles 126 may extend from the top end of the second hinge member 136*b*. The handles 126 may have various shapes and configurations. For example, the handles 126 may bend or extend generally forwardly and have a terminating free end. However, the handles 126 could extend rearwardly, have a loop or closed shape or have other configurations.

In a preferred embodiment, the rear portion of the frame 122 is moveable relative to the front portion, such as to move the physical assistance device 120 from a "use" position to a "stowed" or storage position. As indicated above, the two portions which comprise the rear portion of the frame 122 may be connected to the front portion thereof via hinge connections. Such hinges comprise the pairs of first and second hinge members 136*a,b*. In one embodiment, the second hinge member 136*b* of each hinge comprises a generally vertically extending support. The second hinge member 136*b* may be supported by the branching portion 125*a,b* of the front legs 124*a,b* and the top strut 128.

The first hinge member 136*a* of each hinge may comprise a sleeve which is mounted for rotation relative to its corresponding second hinge member 136*b*. For example, the first hinge member 136*a* may be located over the second hinge member 136*b*.

In this configuration, the first and second hinge members 136*a,b* of each hinge connection may move relative to one another. This permits the rear portion of the frame (comprising the two rear legs 132*a,b* and their associated seat portions 140*a,b*), to move between the positions illustrated in FIGS. 7 and 8, as described in more detail below.

It is possible for the rear portion of the frame 122 to not be movable. In the alternative, other types of connections may be used to permit the rear portion(s) to move relative to the front portion. For example, each support 180 and seat mount 144 may independently be mounted for rotation relative to the front portion of the frame 122, rather than to a common first hinge member 136*a*. Also, the front and rear portions could be mounted about one or more pins, thus permitting their movement relative to one another, rather than the sleeve type arrangement illustrated. Of course, other means and methods for movably connecting the members may be provided as is known to those of ordinary skill in the art.

As with the first embodiment, the second embodiment of the physical assistance device 120 may be constructed of various materials and have other configurations and features. For example, the various portions of the frame 122 may be constructed of generally circular hollow metal tubing. The tubing may be welded together at the joins to provide a strong supporting structure. Further, the variations described above relative to the physical assistance device 20 of the first embodiment may apply to the second embodiment.

In one embodiment, the physical assistance device 120 may include a user control for moving the seat portions 140*a,b* between their retracted and extended positions. Such a control might comprise one or more levers or other devices which the user may move in order to effectuate movement of the seat portions 140*a,b*. Such a control may include an aid, such as one or more springs or other biasing members which either provide an assistive force or which, when triggered or released, automatically move the seat portions 140*a,b*. In other embodiments, such a control might even be electrically controlled, such as with one or more motors.

Relative to the embodiment illustrated in FIGS. 6 and 7, such a control may cause the seat supports 156 to be rotated or pulled down into from their vertical stowed position to their horizontal use position. Such a control might comprise a cable which when pulled pulls the seat supports 156 downwardly. Such a cable or other control may simultaneously cause the seat backs 146 to move to their extended positions (though it is not preferred, it is possible for the seat backs to move independently of the seat supports). The cable(s) or other control may be located in a protective sleeve, run through hollow interior portions of the support members 144, rear legs 132*a,b* or the like.

The use of the second embodiment physical assistance device 120 is similar to that of the first embodiment. Referring first to FIG. 7, a user may utilize the physical assistance device 120 as a standing or walking aid. In particular, a user may enter the generally open interior of the physical assistance device 120 from the rear thereof when the seat portions 140*a,b* are in their retracted position. As illustrated, in this position the seat surfaces 156 and seat backs 146 extend generally vertically (they may rest upon or be fixed on adjustable stops) and thus do not extend inwardly into the interior space of the physical assistance device 120. In this position, the seat portions 140*a,b* thus do not interfere with a user's ingress into or egress out of the interior of the physical assistance device 120 or the user standing or walking while located in the interior of the device.

A user may grip the handles 126, the upper strut 128 or even the supports 180 for support in standing or walking. Though the physical assistance device 120 need not include wheels (in which event the device 120 can still be used as a walking aid by the user lifting and moving the device 120 as the user walks), the physical assistance device 120 is particularly suited for use as a rollator when it includes wheels 130. In particular, a user of the physical assistance device 120 can roll the device as they walk.

When a user uses the physical assistance device 120 as a standing or walking aid, they face forwardly in the interior space defined by the physical assistance device 120. As illustrated in FIG. 6, the physical assistance device 120 is configured to support a user in a seated position. Most advantageously, the physical assistance device 120 is configured to permit a user to sit while they remain facing forward.

As illustrated in FIG. 6, a user may move the seat portions 140*a,b* from their retracted position to their extended position. As illustrated, the seat surfaces 156 may be moved to a position in which they extend inwardly to form a generally planar, horizontal seat. Likewise, the seat backs 146 extend inwardly, generally closing the rear of the physical assistance device 120 and forming a seat back.

When the seat portions 140*a,b* include seat legs 152*a,b*, those legs 152*a,b* preferably extend down from the seat supports 156 to engage a support surface along with the wheels 130 of the front legs 124*a,b* and rear legs 132*a,b*. In this manner, the legs 152*a,b* serve to aid in supporting the seat supports 156.

In this position, a forward-facing user of the physical assistance device 120 may simply sit down onto the seat formed by the seat portions 156. The user may sit back to allow their back to be supported by the seat backs 146.

As with the first embodiment physical assistance device 20, in this position the physical assistance device 120 may also be used as a transport chair. In particular, another person might roll the physical assistance device 120 from one location to another as it supports the seated user. As with the first embodiment, the handles 126 might be rotatable or other handles might be provided for convenient use by the person who pushes or moves the physical assistance device 120 as it supports the seated user.

In a preferred embodiment, the physical assistance device 120 may be moved to a stowed or stored position when it is not in use. Referring to FIG. 8 and as detailed above, the rear portion of the frame 122 may be moved relative to the front portion. In particular, the seat portions 140*a,b* and corresponding rear leg 132*a,b* at each side of the physical assistance device 120 may be rotated about its hinged connection to the front portion of the frame 122.

As illustrated, those portions may be rotated inwardly towards the front portion. In this position, the physical assistance device 120 is collapsed so that it has a reduced dimension. The hinge members, such as the first and second hinge members 136*a,b* at each side of the frame 122, may include one or more locks to retain the physical assistance device 120 in this position. This prevents, for example, the rear portions of the device 120 (including the seat portions 140*a,b* and the rear legs 132*a,b*) from inadvertently swinging outward when the user wishes to maintain the physical assistance device 120 in its stowed position. For example, this may ensure that the physical assistance device 120 is maintained in its stowed position while a user places the physical assistance device 120 in a vehicle or in a closet. Of course, various locking mechanisms might be utilized. For example, the hinge members 136*a,b* might have a spring loaded pin and mating hole (s), wherein when the pin is in a corresponding hole the members 136*a,b* are prevented from rotating relative to one another. The lock(s) might also comprise slide locks or even one or more members which may be moved or rotated into position to catch the rear portion of the frame 122.

Similarly, when the rear portions of the frame 122 are moved to the position as illustrated in FIG. 7, one or more locks may maintain the frame 122 in its extended position. Such lock(s) may serve to prevent the frame 122 from collapsing into its stowed position when a user is using the device.

Of course, the physical assistance device of the present invention may have other configurations. Most importantly, the physical assistance device is both configured as a walking aid and is configured to support the user in a seated position without the user having to turn around to be seated. Most preferably, the device is configured to support a user in a standing or walking position in a forward-facing direction (facing a front of the device) and to also support the user in a seated position in the same forward-facing direction. Thus, for example, the front portion of the frame of the device might have other shapes or configurations and/or a seat portion of the physical assistance device might have other configurations, while the device still maintains this desired configuration. For example, there might be a single seat portion which is hinged at one side of the physical assistance device. This single seat portion might rotated between a retracted position and a seated position in which it extends across the entire rear of the physical assistance device. It is also possible for the seat portions to have other configurations and to be mounted to the frame of the physical assistance device in other manners. It is also possible for the device to have a greater or lesser number of legs (such as three legs or five or more legs).

It is also possible for the one or more seat portions to move between other retracted positions. For example, the seat portions might fold or rotate from the rear of the physical assistance device into other positions.

It will also be appreciated that the physical assistance device might have other elements, including other supports, legs and the like. For example, for further configuration of the physical assistance device as a transport chair, the physical assistance device might include a pair of removable feet/leg supports that the user may rest their feet or legs upon in a raised position on while they are pushed by another person.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A physical assistance device which may be configured as a walking aid and alternatively support a user in a seated position comprising:

a front frame portion having a front, a first side and a second side spaced from said first side, at least a pair of spaced front legs, a first vertically extending support located at said first side and a second vertically extending support located at said second side, said first and second vertically extending supports located rearward of said pair of spaced front legs, each front leg supported by at least one wheel, said front of said front frame portion defining a generally closed front of said physical assistance device;

a first rear frame portion comprising at least one first rear leg supported by at least one wheel, said first rear frame portion movably mounted to said first vertically extending support;

a second rear frame portion comprising at least one second rear leg supported by at least one wheel, said second rear frame portion movably mounted to said second vertically extending support;

said first and second rear frame portions moveable between an expanded position in which said first frame portion extends rearwardly from said first side of said front frame portion and second frame portion extends rearwardly from said second side of said front frame portion and said physical assistance device has an interior area defined by said front frame portion and first and second rear frame portions and a collapsed position in which said first and second rear frame portions are rotated towards said front of said front frame portion into said interior area, whereby a size of said physical device is reduced;

a first seat surface movably mounted to said first rear frame portion and a second seat surface movably mounted to said second rear frame portion, each of said first and second seat surfaces movable about a horizontal axis between a retracted position and an extended position; and said physical assistance device having a first configuration for use by a user when walking wherein when said first and second rear frame portions are in their expanded positions and said first and second seat portions are in their retracted positions, said rear of said physical assistance device is unobstructed, permitting said user to walk into said interior of said physical assistance device from said rear thereof and walk while facing said front of said physical assistance device, and a second configuration for supporting a user in a seated position wherein when said first and second rear frame portions are in their expanded positions and said first and second seat portions are in their extended positions they span said rear of said physical assistance device to form a unitary seat for supporting a user in a seated position facing said front of said physical assistance device.

2. The physical assistance device in accordance with claim 1 further including a first seat support leg connected to said first seat support and a second seat support leg connected to said second seat support leg, said first and second seat support legs extending downwardly from said first and second seat supports to support said seat when said first and second seat supports are in their extended position.

3. The physical assistance device in accordance with claim 1 wherein said first rear frame portion is rotatably connected to said front frame portion for rotation about a first vertical axis and said second rear frame portion is rotatably connected to said front frame portion for rotation about a second vertical axis.

4. The physical assistance device in accordance with claim 1 wherein said front frame portion has a first side and a second side and said first rear frame portion is movably connected to said front frame portion at said first side and said second rear frame portion is movably connected to said front frame portion at said second side.

5. The physical assistance device in accordance with claim 1 wherein when said first and second seat surfaces are in their extended positions and form said seat, said seat is located at an elevation approximately mid-way between a top and a bottom of said physical assistance device.

6. The physical assistance device in accordance with claim 1 wherein when said physical assistance device is in said first configuration, said seat supports a user in a position in which their legs extend generally horizontally outward and then generally vertically downward to a support surface.

7. The physical assistance device in accordance with claim 1 wherein said first rear frame portion further comprises a sleeve which is mounted over said first vertically extending support, permitting said first rear frame portion to rotate about said first vertically extending support and wherein said second rear frame portion further comprises a sleeve which is mounted over said second vertically extending support, permitting said second rear frame portion to rotate about said second vertically extending support.

8. The physical assistance device in accordance with claim 1 wherein said first rear frame portion comprises a horizontally extending lower mount and said first seat surface is mounted for rotation around said lower mount and wherein said second rear frame portion comprises a horizontally extending lower mount and said second seat surface is mounted for rotation around said lower mount.

9. The physical assistance device in accordance with claim 8 wherein said first rear frame portion further comprises a horizontal support which is located above said lower mount and said second rear frame portion further comprises a horizontal support which is located above said lower mount.

10. The physical assistance device in accordance with claim 1 wherein said first seat portion is mounted between said first vertically extending support and said at least one first rear leg and said second seat portion is mounted between said second vertically extending support and said at least one second rear leg.

11. The physical assistance device in accordance with claim 1 wherein said first rear frame portion further comprises a first seat back portion and said second rear frame portion further comprises a second seat back portion.

12. The physical assistance device in accordance with claim 11 wherein said first and second seat back portions extend generally horizontally inward towards one another rearward of said first and seat surfaces and above said first and second seat surfaces when said first and second seat surfaces are in their extended position.

* * * * *